United States Patent [19]

Klein

[11] Patent Number: 4,771,596

[45] Date of Patent: Sep. 20, 1988

[54] METHOD OF MAKING FIBER COMPOSITE

[75] Inventor: William G. Klein, Wellesley, Mass.

[73] Assignee: Brunswick Corporation, Skokie, Ill.

[21] Appl. No.: 262,108

[22] Filed: Jun. 12, 1972

Related U.S. Application Data

[62] Division of Ser. No. 29,822, Apr. 20, 1970, Pat. No. 3,678,675.

[51] Int. Cl.[4] ..... D01G 1/06; D01G 13/00; D02G 3/04; D02G 3/12

[52] U.S. Cl. ..... 57/2; 19/0.35; 19/0.56; 19/0.58; 19/145.5; 19/145.7; 57/12; 57/238; 57/244; 57/252; 57/255; 57/315; 57/327; 57/901

[58] Field of Search ..... 57/3 C, 140 BY, 157 R, 57/157 AS, 156, 2, 3, 12, 315, 317, 327, 331, 238, 244, 252, 255, 210, 901; 19/0.3–0.64, 66 R, 145.5, 145.7

[56] References Cited

U.S. PATENT DOCUMENTS

| | | | |
|---|---|---|---|
| 73,866 | 1/1868 | Bachelder . | |
| 1,848,667 | 3/1932 | Scott | 19/2 |
| 1,883,384 | 10/1932 | Lohrke et al. | 19/35 |
| 2,040,519 | 5/1936 | Lohrke et al. | 57/200 |
| 2,082,840 | 6/1937 | Lohrke | 19/39 |
| 2,132,524 | 10/1938 | Booth | 19/43 X |
| 2,160,178 | 5/1939 | Sitzler et al. | 57/12 |
| 2,260,383 | 10/1941 | Killars, Jr. | 19/51 |
| 2,419,320 | 4/1947 | Lohrke | 19/41 X |
| 2,508,852 | 5/1950 | Blumfield | 57/901 X |
| 2,517,946 | 8/1950 | Von Kohorn | 57/2 X |
| 2,563,756 | 8/1951 | Swallow | 19/51 |
| 2,640,229 | 6/1953 | Gwaltney | 19/157 |
| 2,640,664 | 6/1953 | Porter | 242/157 |
| 2,700,187 | 1/1955 | McKenna et al. | 19/66 |
| 2,800,686 | 7/1957 | Long et al. | 19/26 X |
| 2,813,309 | 11/1957 | West et al. | 19/26 |
| 2,908,043 | 10/1959 | Whitney | 19/6 |
| 2,941,259 | 6/1960 | Lohrke | 19/39 |
| 2,990,673 | 7/1961 | Adkins | 57/12 |
| 3,020,697 | 2/1962 | Henry | 57/315 |
| 3,035,404 | 5/1962 | Roscoe | 57/317 |
| 3,082,593 | 3/1963 | Rhyne | 57/206 |
| 3,086,347 | 4/1963 | Keen et al. | 57/317 |
| 3,099,066 | 7/1963 | Scharf | 57/2 X |
| 3,126,924 | 3/1964 | Kirkpatrick | 139/425 |
| 3,141,203 | 7/1964 | Whitehurst et al. | 19/263 |
| 3,153,315 | 10/1964 | Arthur et al. | 57/207 |
| 3,243,853 | 4/1966 | Whitehurst | 19/240 |
| 3,247,551 | 4/1966 | Whitehurst | 19/66 R |
| 3,277,564 | 10/1966 | Webber et al. | 57/901 X |
| 3,288,175 | 11/1966 | Valko | 139/425 |
| 3,289,255 | 12/1966 | Whitehurst | 19/240 |
| 3,291,897 | 12/1966 | Bramley | 57/901 X |
| 3,345,696 | 10/1967 | Whitehurst | 19/26 |
| 3,371,247 | 2/1968 | Mullenger | 57/901 X |
| 3,377,663 | 4/1968 | Arai et al. | 19/39 |
| 3,379,000 | 4/1968 | Webber et al. | 57/901 X |
| 3,394,541 | 7/1968 | Rhyne | 57/91 |
| 3,409,946 | 11/1968 | Whitehurst | 19/292 |
| 3,422,460 | 1/1969 | Burke et al. | 57/901 X |
| 3,447,206 | 6/1969 | Klein et al. | 19/243 |
| 3,520,493 | 7/1970 | Carroll | 242/157 |
| 3,582,444 | 6/1971 | Ngo et al. | 57/238 X |
| 3,582,445 | 6/1971 | Okuhashi | 57/901 X |

(List continued on next page.)

*Primary Examiner*—John Petrakes
*Attorney, Agent, or Firm*—Wood, Dalton, Phillips, Mason & Rowe

[57] ABSTRACT

A fine heterogeneous hybrid spun yarn is blended from electrostatically conductive staple fibers and electrostatically non-conductive staple fibers so that the yarn is electrostatically conductive only over short discrete lengths. When used in pile fabrics, such as carpets, the fine yarn is introduced with at least some of the carpet facing yarns during the carpet making operations. The resultant carpet structure substantially eliminates electrostatic shock to a human walking across the carpet and approaching a ground such as a light switch, radio, or another person. Such a carpet does not constitute a dangerous floor covering.

The unique heterogeneous hybrid spun blended yarn is achieved by process techniques completely contrary to accepted blending practices.

25 Claims, 3 Drawing Sheets

U.S. PATENT DOCUMENTS

| | | | |
|---|---|---|---|
| 3,582,448 | 6/1971 | Okuhashi et al. | 57/901 X |
| 3,586,597 | 6/1971 | Okuhashi | 57/901 X |
| 3,611,700 | 10/1971 | Vivien | 57/2 |
| 3,670,485 | 6/1972 | Brown et al. | 57/327 |
| 3,678,675 | 7/1972 | Klein | 57/238 X |
| 3,690,055 | 9/1972 | Norris | 57/2 X |
| 3,699,590 | 10/1972 | Webber et al. | 57/901 X |
| 3,703,073 | 11/1972 | Goodbar et al. | 57/2 |
| 3,828,543 | 8/1974 | Goodbar et al. | 57/901 X |

FOREIGN PATENT DOCUMENTS

| | | |
|---|---|---|
| 1048538 | 1/1959 | Fed. Rep. of Germany . |
| 1143690 | 4/1957 | France . |
| 45-32366 | 10/1970 | Japan . |
| 259093 | 1/1949 | Switzerland . |
| 372274 | 10/1930 | United Kingdom . |
| 501155 | 2/1939 | United Kingdom . |
| 519200 | 3/1940 | United Kingdom . |
| 1137814 | 12/1968 | United Kingdom . |
| 1240615 | 7/1971 | United Kingdom . |

OTHER PUBLICATIONS

"Space Age Yarn Tests", Man-Made Textiles, Jan. 1966, vol. 43, No. 499, p. 33.

Webber "Metal Fibers", Modern Textile Mag., May 1966, pp. 72–75.

Fig. 10
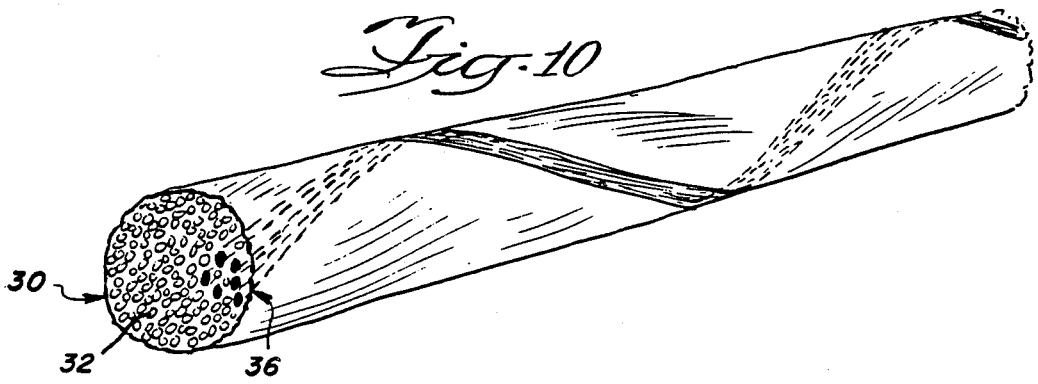
Fig. 7
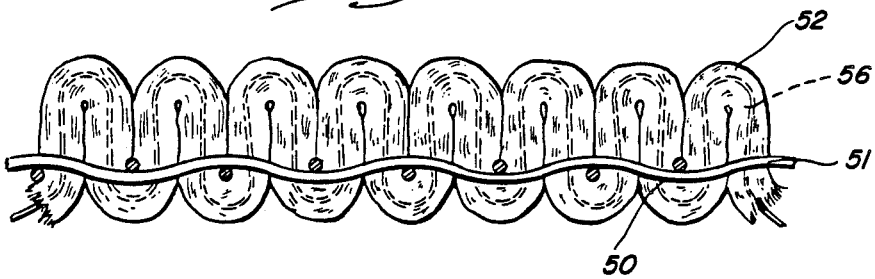
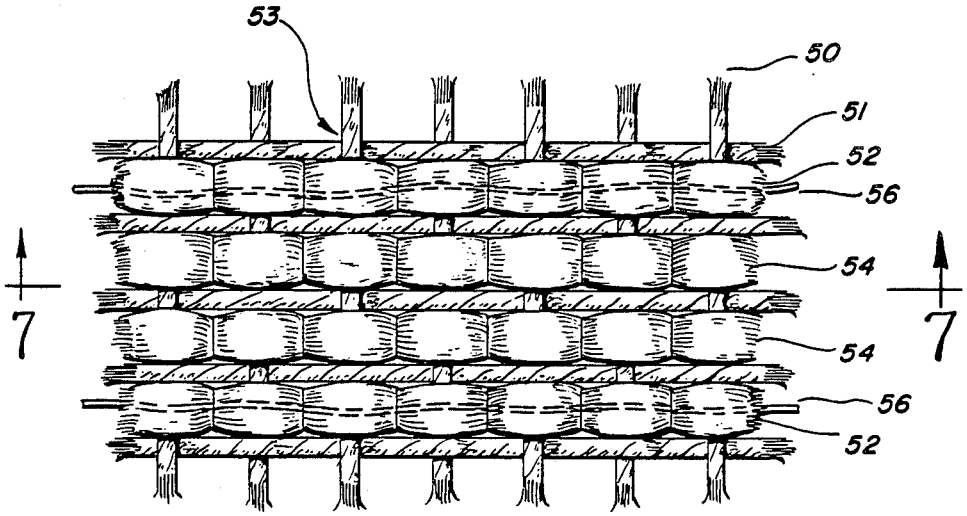
Fig. 6

METHOD OF MAKING FIBER COMPOSITE

CROSS REFERENCE TO CO-PENDING APPLICATION

This application is a divisional continuation application of my co-pending application for U.S. patent Ser. No. 29,822, filed Apr. 20, 1970, now U.S. Pat. No. 3,678,675.

BACKGROUND OF THE INVENTION

1. Field of the Invention

This invention is in the field of fabrics and, more particularly, in the field of antistatic fabrics.

2. Description of the Prior Art

With the advent of carpeting an extremely annoying but usually not dangerous problem has plagued humans, the shock or jolt of a static electricity discharge received after walking or shuffling across a carpet and touching an electrical ground, such as a lamp, light switch, TV, or water faucet. This poblem is much more prevalent during periods of cold temperatures when the relative humidity inside a heated building is low. In an effort to eliminate this problem, many different types of solutions have been tried; for example, (1) chemical treatments (antistats) applied to the carpet-facing yarn fibers by spraying, coating, etc., (2) fine continuous metal wires (having a diameter ranging from three to ten mils) woven with the carpet facing into the backing fabric, (3) a conductive latex applied to the backing fabric, and (4) the use of special synthetic fibers that have a surface capable of sbsorbing moisture. Each of these solutions has proven unsatisfactory either because (1) it does not work at all, (2) it works for only a short period of time, (3) it works only under certain conditions, i.e., when the relative humidity is sufficiently high so that no antistatic method is really needed, or (4) it can be extremely dangerous in the case of fine electrically continuous metal wires. In fact, carpets with such continuous wires have been tested and it was found that the low electrical resistance of the continuous fine metal wire in the carpet creates the atmosphere for an electrical hazard. Under the proper conditions, a person having wet shoes or being barefoot touching a faulty lamp while standing on such a carpet can incur serious injury. In other words, such carpets under certain conditions can be extremely dangerous.

In U.S. Pat. Nos. 3,277,564 and 3,379,000, owned by the assignee hereof, Webber et al teach a new metal filament having the characteristics of a textile. Valko, in U.S. Pat. No. 3,288,175, recognized the advantages of these metal filaments and taught that if such continuous metal filaments were provided in association with continuous filament synthetic yarns and then woven into a grid structure fabric, the resulting fabric would exhibit antistatic characteristics. In order to insure an antistatic fabric, Valko teaches that there must be a continuous filament metal-to-metal contact in the yarn wherein the metal filaments comprise approximately 10% by weight of the textile fabric. Valko's continuous metal filament portion of the continuous filament yarn or the continuous metal-to-metal contact of a spun blended yarn would produce a carpet that would function similarly to the fine continuous metal wire and could be just as dangerous.

One solution to providing an antistatic carpet that is not dangerous has been taught by Brown and Webber in their application for U.S. patent Ser. No. 643,983, filed June 6, 1967 (now abandoned), and owned by the assignee hereof.

Brown et al recognized that it was possible to blend staple synthetic or natural textile fibers with staple electrically conductive fiber (which could be a textile metal fiber) wherein the electrically conductive fiber constitutes less than one per cent by weight of the blend, in order to provide an antistatic textile yarn or textile fabric. This spun blended staple yarn has been used by the carpet industry as the facing yarn. It has been found that as little as $\frac{1}{3}$ to 1/6 of one per cent by weight of the conductive fiber is effective to control a static electricity build-up in a carpet when used continuously in adjacent carpet facing yarns and when a conductive latex coating is applied to the baking fabric.

Although the Brown-Webber method provides a good antistatic carpet made from spun blended staple yarns, it is not adaptable to continuous filament carpets. According to the American Carpet Institute, about 80 percent of all carpets sold in the United States are made from continuous filament yarns and only 20 percent are made from spun yarns. There has been an ever-increasing shift from natural fibers for carpets (i.e., wool) to synthetic filaments which can be made in a continuous form. The Brown-Webber method, although a fine system, is limited to staple carpet facing yarns and therefore not useful in the standard continuous filament carpet field.

INTRODUCTION

As discussed heretofore, many teachings have been advanced to make textiles "antistatic", and recently many statements have been made in an attempt to follow the Brown-Webber lead in the "antistatic non-dangerous" textile field. The culmination of these attempts has caused the introduction of terms such as "non-static textiles", "semi-static free textiles", "low-static textiles" and "partially antistatic textiles". However, there has been no meaningful definition of these terms to quantitatively or qualitatively independently identify such textiles.

It is common knowledge that an electrostatic potential can be developed when walking and/or shuffling over a carpet. When the potential is 2500 volts or more, this voltage creates an annoying and uncomfortable static electric shock to a human when nearing a ground that causes a spark discharge. Accordingly an electrostatic potential of 2500 volts is acknowledged as an undesirable voltage level. This has been adopted by the architectural profession and is currently in the process of being adopted as an industry standard. Therefore, as used hereinafter in this disclosure "antistatic fabric" is defined as a fabric not capable of generating a static electrical potential of 2500 volts on an individual under ordinary use conditions. As used hereinafter in this disclosure, the term "electrostatic non-conductive" or "electrostatically non-conductive is defined to refer to a material that has a resistivity in excess of $10^{10}$ ohm centimeters. As used hereinafter in this disclosure, the term "electrostatically conductive" is defined to refer to a material having a resistivity of less than $10^5$ ohm centimeters. To be meaningful, these resistivity values are to be measured when the relative humidity is approximately 20% or lower and the temperature is approximately 60° to 80° F.

SUMMARY OF THE INVENTION

This invention relates to fabrics and is concerned with a new and novel antistatic fabric structure made with new and novel yarns that provide the antistatic characteristics to the textile fabric and especially adapted to carpets. The invention also relates to methods of making new and novel yarns.

It is a primary object of this invention to provide an antistatic fabric particularly adapted to carpets made by combining continuous filament yarns with a fine spun blended yarn that has short lengths of continuous electrostatic conductivity, and whereby such a fabric functions to control static electricity and is not electrically dangerous.

A feature of this invention is the provision that the spun yarn is heterogeneously blended from electrostatically conductive and electrostatically non-conductive fibers.

Yet another feature of this invention is the provision that the facing yarns of the carpet have less than 0.5% by weight of the electrostatically conductive fibers therein.

Still another feature of this invention is the provision that a fine staple discontinuously electrostatically conductive yarn blended from electrostatically conductive staple fibers and electrostatically non-conductive fibers can be woven or tufted directly into the carpet backing fabric, along with the facing yarns, or plied therewith prior to weaving or tufting.

And another feature of this invention is the provision that the antistatic level of the carpet can be controlled by pre-selecting the fine static control yarn spacing in the carpet structure.

And still another feature of the invention is to provide a heterogeneously hybridly blended fine spun yarn made from electrostatically non-conductive and electrostatically conductive staple fibers wherein such a yarn is not a homogeneous, uniform or intimately blended yarn.

Another feature of this invention is the provision for making such a yarn by combining organic sliver and continuous filaments in a roller drafting machine followed by roving and single roving spinning operations.

Still another feature of this invention is the provision that the conductive fibers in the fine yarn are in a clustered arrangement that migrates radially along the length of the yarn.

Another feature of this invention is to provide a heterogeneously hybrid composite sliver and the method of making the composite sliver by simultaneously breaking and blending continuous filaments in combination with a sliver.

The above and other and further objects and features will be more readily understood by reference to the following detailed description and the accompanying drawings.

DESCRIPTION OF THE DRAWINGS

FIG. 6 is an enlarged and distorted representation of a section of a tufted carpet;

FIG. 7 is a cross section of the carpet of FIG. 6;

FIG. 10 is an enlarged diagrammatic view of a section of the fine heterogeneous yarn.

DESCRIPTION OF THE PREFERRED EMBODIMENTS

By way of introduction, it is necessary first to make the fine discontinuously electrostatically conductive staple blended yarn. This yarn is combined with standard carpet facing yarns in a pre-selected arrangement in order to provide the desired antistatic carpet. Thus, this yarn and method for making this yarn comprise sub-combinations of the total carpet systems.

In a preferred embodiment of the invention, a fine spun yarn made from electrostatically non-conductive staple fibers are represented by "organic fibers" and electrostatically conductive staple fibers are referred to as conductive fibers. The organic fibers may be made from synthetic materials including nylon, acrylic, polyester and the like, as well as natural materials including wool, cotton, flax, and the like, or any desired mixtures thereof. The conductive fibers may be made from materials including metal fibers (e.g., the Webber et al fibers), organic fibers having an electrostatically conductive surface coating thereon, or the like. The conductive fibers used generally have a size range of approximately 25 microns to 2 microns or less. The organic fibers used generally have a size range of 0.11 Tex to 2 Tex. The international Tex measurement system (grams per 1000 meters) is being used herein for ease of understanding because some of the older textile measuring systems are associated with specific textile yarn forming systems, e.g., cotton, wool, and worsted. The metal fibers used herein can have a rough, unmachined, unburnished and reentrant fracture-free outer surface which facilitates blending with organic fibers.

Figure 1:
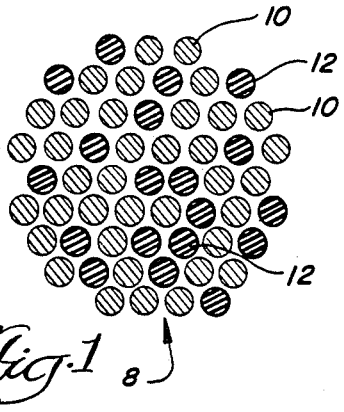
FIG. 1 is a cross section of a homogeneously blended spun yarn.

It is axiomatic in the textile industry that uniform, intimate and homogeneous blends of spun textile yarns are desired, whether different fiber materials or nominally the same fiber materials are being blended. Several reasons for trying to achieve a uniform, intimate, homogeneous blend are: (1) reproducibility of the yarn's physical properties, (2) good dyeing properties, (3) uniform abrasion resistance, and the like. It is customary, therefore, in making spun blended yarns that the component slivers are drawn and doubled together a number of times, as well as frequently using double roving spinning, in an attempt to produce a uniform, intimate, homogeneous spun blended yarn. A typical cross section of such a yarn is shown in FIG. 1 wherein yarn 8 is a spun blend illustrating a 35% cotton—65% polyester yarn with the cotton fibers 12 and the polyester fibers 10.

Figure 2:
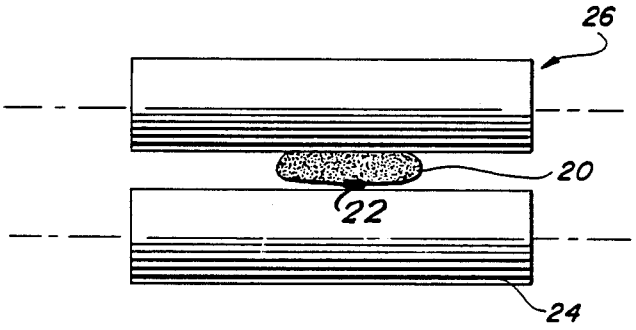
FIG. 2 is a partial cross section of a roller drafting machine containing a sliver and a tow.
Figure 3:
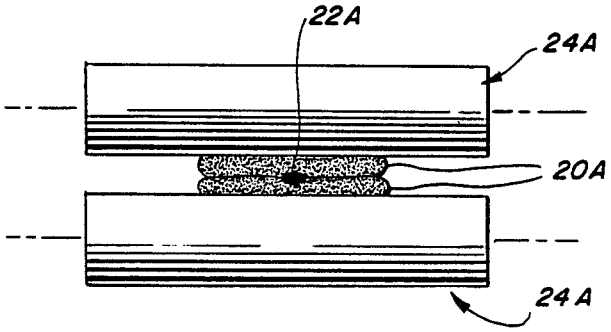
FIG. 3 is a partial cross section of a roller drafting machine containing two slivers and a tow.

It was quite surprisingly found that in order to achieve improved antistatic properties in the spun yarn and the resulting fabric, it was necessary to employ blending techniques contrary to accepted standards to produce the fine heterogeneous hybrid, non-uniform, non-intimate and non-homogeneous spun blended yarn which is a preferred embodiment of this invention. The heterogeneous yarn so formed provided a significantly improved yarn to make an antistatic fabric. One method of producing such a yarn is to combine at least one pre-drawn organic sliver with a consolidated tow of conductive filaments. The organic sliver and tow of conductive filaments are passed in a roller drafting machine wherein the metal filaments are broken into staple and blended with the organic sliver by the drawing action of the machine to produce the heterogeneous or non-homogeneous blend. Thus, a new heterogeneous blended sliver is formed. In FIG. 2, the organic sliver 20 and the tow of conductive filaments 22 are introduced at the backing rolls 24 of a portion of roller drafting machine 26. Suitable roller drafting machines include the Perlock, Turbo, Gastonia rebreakers and the like.

In another embodiment, as shown in FIG. 2, the tow of conductive filaments 22A is introduced in the roller drafting machine 26A at the backrolls 24A inbetween the organic slivers. During the drawing and blending, the conductive fibers remain in close proximity to each other undergoing the minimum possible amount of mixing or blending. This produces the heterogeneously blended sliver. The resultant sliver is then processed on a roving frame to produce a roving. The roving is then spun into yarn by the use of single roving spinning. The amount of conductive fiber used can vary in a range from under 1% to approximately 30%. When metal filaments, preferably each having a diameter from 15 microns to 2 microns, are used it has been found desirable to use this material in weight ratios of approximately 2%, 4%, 6%, 8%, 10%, 12%, 13% 15%, 20% and 25% to the organic material. It has also been found that the weight percentage for the metal fibers can vary according to size of metal filament used, as well as the weight of the organic fiber being used. Alternatively, when using a conductive filament that comprises a conductive coating on an organic substrate filament, the weight ratios will vary depending on the weight of the conductive fiber and the organic fiber.

Figure 4:
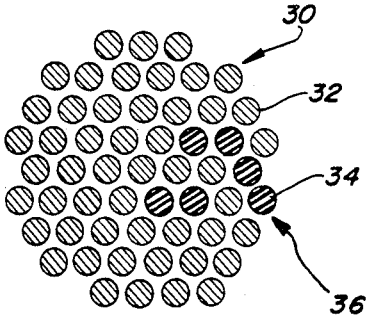
FIG. 4 is a cross section of a heterogeneously hybridly blended spun yarn with the conductive fibers in a compact cluster form.

By this completely unorthodox method of making a spun yarn, a heterogeneous hybrid blended yarn 30 is produced as shown in FIG. 4 wherein a cross section of this yarn 30 contains organic staple fibers 32 and conductive fibers 34. The cluster of the staple conductive fibers 34 indicates that the blend is heterogeneous or non-uniform, non-intimate and non-homogeneous. It has been observed that this cluster 36 of fibers 34 migrates radially along the length of the yarn 30 as shown in FIG. 10.

Figure 5:
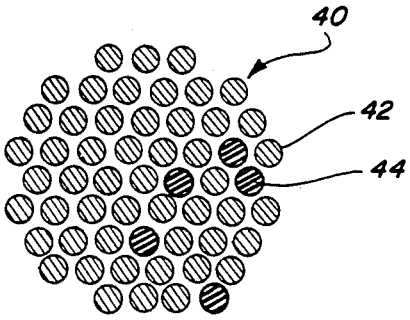
FIG. 5 is a cross section of another heterogeneously hybridly blended spun yarn with the conductive fibers in a cluster form.

In another similar method when organic fiber sliver and conductive fiber sliver are passed once through a pin drafter, reduced on a roving frame and single roving spun, a heterogeneous hybrid spun blended yarn was also produced. A cross section of the yarn 40 of FIG. 5 is illustrative of the yarn produced by the method wherein the organic staple fibers 42 are not very well blended with the conductive fibers 44.

It was found that the cluster of conductive fibers 44 was more dispersed in the yarn 40 than the conductive fibers 34. It is believed that this difference in heterogeneity is attributed to the fact that it is possible to introduce the conductive material only in sliver form in the pin drafter losing the ability to provide the same clustered compactness as the conductive filaments delivered to the roller drafter. The pin drafter inherently mixes the fibers to a much higher degree. The weight ratio of the fibers and the size is essentially the same as mentioned before.

The fine heterogeneously blended yarns may be made in any desired size from approximately 45 Tex to as small as 10 Tex depending on the application of the yarn. For use in antistatic carpets, it has been found that a yarn having a range from 35 Tex to 15 Tex is desirable. The individual synthetic fibers in the yarn can have a range of from 0.11 Tex to 2 Tex with a 0.22 Tex to 0.55 Tex being a desirable size range. It has been found that by using more but smaller diameter conductive fibers in a highly heterogeneous cluster, the weight percent of the conductive fibers can be reduced and yet provide better overall results. In order to prevent the disadvantage of continuous contact between the conductive fibers, the proper weight ratio (number of conductive fibers per yarn cross section), the proper heterogeneous blending and the proper spinning provide yarns that exhibit contact between conductive fibers over preselected short lengths of the yarn. Thus, it has been found that for different yarns made by different textile systems; e.g., cotton, woolen and worsted, the longest continuous contact length of conductive contact is a function of the average staple length and the number of conductive fibers in cross section. Tests have shown that the desired antistatic characteristics for the carpets are obtained when the longest conductive contact of conductive fibers is approximately 8 feet or less for the fine heterogenerous yarn to function properly, thereby avoiding the hazard of the continuous contact taught in the prior art. Since textile blending is not precise and demonstrably accurately reproducible, there will always be a few minor exceptions to the longest conductive contact length.

The following examples of specific fine heterogeneous blended yarns containing conductive and non-conductive fibers made in accordance with this invention should not be construed in any way to limit the scope contemplated by this invention.

EXAMPLE 1

A fine heterogeneous hybrid spun blended yarn having approximately 17.72 Tex was blended from nylon fibers having an approximate size of 0.165 Tex and a conductive fiber (stainless steel) having an effective diameter of approximately 12 microns. The conductive staple fiber (metal) constituted approximately 25% by weight of the total yarn weight. The nylon fiber sliver and metal fiber sliver were first drafted and blended forming a combined sliver. The combined sliver was reduced on a roving frame and then single roving spun directly into the fine heterogeneous hybrid spun yarn. This yarn exhibited continuous contact between conductive fibers over a length ranging from 2 feet to 3 feet.

EXAMPLE 2

A fine heterogeneous hybrid spun blended yarn was made in the fashion as Example 1 and was the same size except that the conductive fibers comprised approximately 20% by weight. This yarn exhibited continuous contact between conductive fibers over a length ranging from 2 feet to 2½ feet.

EXAMPLE 3

A fine heterogeneous hybrid spun blended yarn was made in the same fashion as Example 1 and was the same size except that the conductive fiber comprised approximately 15% by weight. This yarn exhibited continuous contact between conductive fibers over a length ranging from 1½ feet to 2 feet.

EXAMPLE 4

A fine heterogeneous hybrid spun blended yarn was made in the same fashion as Example 1 and was the same size except that the conductive fiber comprised approximately 10% by weight. This yarn exhibited continuous contact between conductive fibers over a length ranging from 1 foot to 1½ feet.

EXAMPLE 5

A fine heterogeneous hybrid spun yarn having a size of approximately 18 Tex was blended from nylon fibers having an approximate size of 0.165 Tex and metal fibers having an effective diameter of approximately 8 microns. The metal fibers constituted approximately 12½% by weight of the total yarn weight. The nylon fiber sliver and continuous metal filaments were introduced into a roller drafting machine where the continuous metal fibers were broken and blended with the nylon sliver forming a partially blended sliver. The partially mixed sliver was reduced on a roving frame and then single roving spun directly into the fine heterogeneous hybrid spun blended yarn. The metal fibers were presented in a close clustered form when a cross section of the yarn was examined. The cluster migrated radially along the length of the yarn. This yarn exhibited a continuous contact between conductive fibers over a length ranging from 4 feet to 8 feet.

In a preferred embodiment of the invention the fine heterogeneous yarns discussed hereinabove are combined during the manufacturing of the carpet to provide the desired antistatic characteristics.

By way of definition and as used hereinafter, the term "end" refers to the individual carpet facing yarns that are either woven or tufted into a backing such as a jute fabric. An end may comprise one or more single yarn elements. FIG. 6 is an enlarged representation of a tufted carpet with the backing material 53 having warp yarns 51 and filling yarns 50 comprising the standard grid form of the backing fabric 53. The carpet facing yarns 52 and 54 each are considered ends. During the initial carpet formation, the facing yarns 52 and 54 are secured to the backing by forced insertion between the warp yarns 51 and filling yarns 50. Thereafter many standard means may be employed to further secure the facing yarns to the backing, including flexible coatings such as latex and the like. Generally these continuous filament tufted facing yarns have an approximate size from 166 Tex to 444 Tex. However, since there is no absolute standard, a carpet manufacturer may use any size facing yarn desired. In order to provide an antistatic carpet, a fine heterogeneous blended spun yarn is introduced with carpet facing yarn just prior to tufting. As shown in FIG. 6, the two yarns, the carpet facing yarn 52 and the fine heterogeneous yarn 56, were introduced and tufted together into the backing fabric and secured thereto. Depending on the size of the carpet yarns and the exact construction of the fine heterogeneous blended yarn, there can be a different spacing between carpet facing yarns 52 or ends containing the fine heterogeneous yarn 56 and the standard carpet facing yarns 54. The fine heterogeneous yarn may be used equally satisfactorily in carpets made by (1) weaving continuous filament facing yarns, (2) weaving spun blended facing yarns, (3) tufting spun blended facing yarns, (4) knitting either continuous filament or spun blended carpet yarns and (5) other special carpet making processes. Rather than introducing the fine heterogeneous yarn with carpet facing yarn as the carpet is being made, prior thereto these two yarns can be plied together and introduced in the carpet making step as a plied yarn.

The following examples of specific carpet structures were made containing fine heterogeneous yarns and carpet facing yarns in accordance with this invention, but should not be construed in any way to limit the scope contemplated by this invention.

EXAMPLE 6

A tufted nylon carpet was made using size 288 Tex continuous filament yarn. The facing carpet yarn was tufted into a 10 ounce per square yard jute primary backing. The weight of the carpet facing yarn was approximately 45 ounces per square yard. No fine heterogeneous yarn was used nor was a conductive backing applied to the carpet.

EXAMPLE 7

Same carpet as Example 6, but a fine heterogeneous hybrid spun blended yarn having asize of 18 Tex and containing 12 micron stainless steel metal fibers in a weight ratio of 10% was introduced with every 10th end of carpet facing yarn.

EXAMPLE 8

Same as Example 7 except that the fine heterogeneous blended yarn was introduced with every 5th end of carpet facing yarn.

EXAMPLE 9

Same as Example 7 except that the fine heterogeneous blended yarn was introduced with every 2nd end of carpet facing yarn.

EXAMPLE 10

Same as Example 7 except that the fine heterogeneous blended yarn was introduced with every end of carpet facing yarn.

EXAMPLE 11

Same as Example 7 but with the addition of a conductive latex backing.

EXAMPLE 12

Same as Example 8 but with the addition of a conductive latex backing.

EXAMPLE 13

Same as Example 9 but with the addition of a conductive latex backing.

EXAMPLE 14

Same as Example 10 but with the addition of a conductive latex backing.

EXAMPLE 15

Same carpet as Example 6 but a fine heterogeneous hybrid spun blended yarn having a size of 18 Tex and containing 12 micron stainless steel metal fibers in a weight ratio of 25% was introduced with every 10th end of carpet facing yarn.

EXAMPLE 16

Same as Example 15 except that the fine heterogeneous blended yarn was introduced with every 5th end of carpet facing yarn.

EXAMPLE 17

Same as Example 15 except that the fine heterogeneous blended yarn was introduced with every 2nd end of carpet facing yarn.

EXAMPLE 18

Same as Example 15 except that the fine heterogeneous blended yarn was introduced with every end of carpet facing yarn.

EXAMPLE 19

Same as Example 15 but with the addition of a conductive latex backing.

EXAMPLE 20

Same as Example 16 but with the addition of a conductive latex backing.

EXAMPLE 21

Same as Example 17 but with the addition of a conductive latex backing.

EXAMPLE 22

Same as Example 18 but with the addition of a conductive latex backing.

EXAMPLE 23

Same carpet as Example 6 but a fine heterogeneous hybrid spun blended yarn having an approximate size of 18 Tex and containing 8 micron stainless steel metal fiber in a weight ratio of approximately 12.5%–13% was introduced with every 12th end of carpet facing yarn.

EXAMPLE 24

Same as Example 23 except that the fine heterogeneous blended yarn was introduced with every 8th end of carpet facing yarn.

EXAMPLE 25

Same as Example 23 except that the fine heterogeneous blended yarn was introduced with every 4th end of carpet facing yarn.

EXAMPLE 26

Same as Example 23 except that the fine heterogeneous blended yarn was introduced with every 2nd end of carpet facing yarn.

EXAMPLE 27

Same as Example 15 except that the fine heterogeneous blended yarn was introduced with every end of carpet facing yarn.

Figures 8, 9:
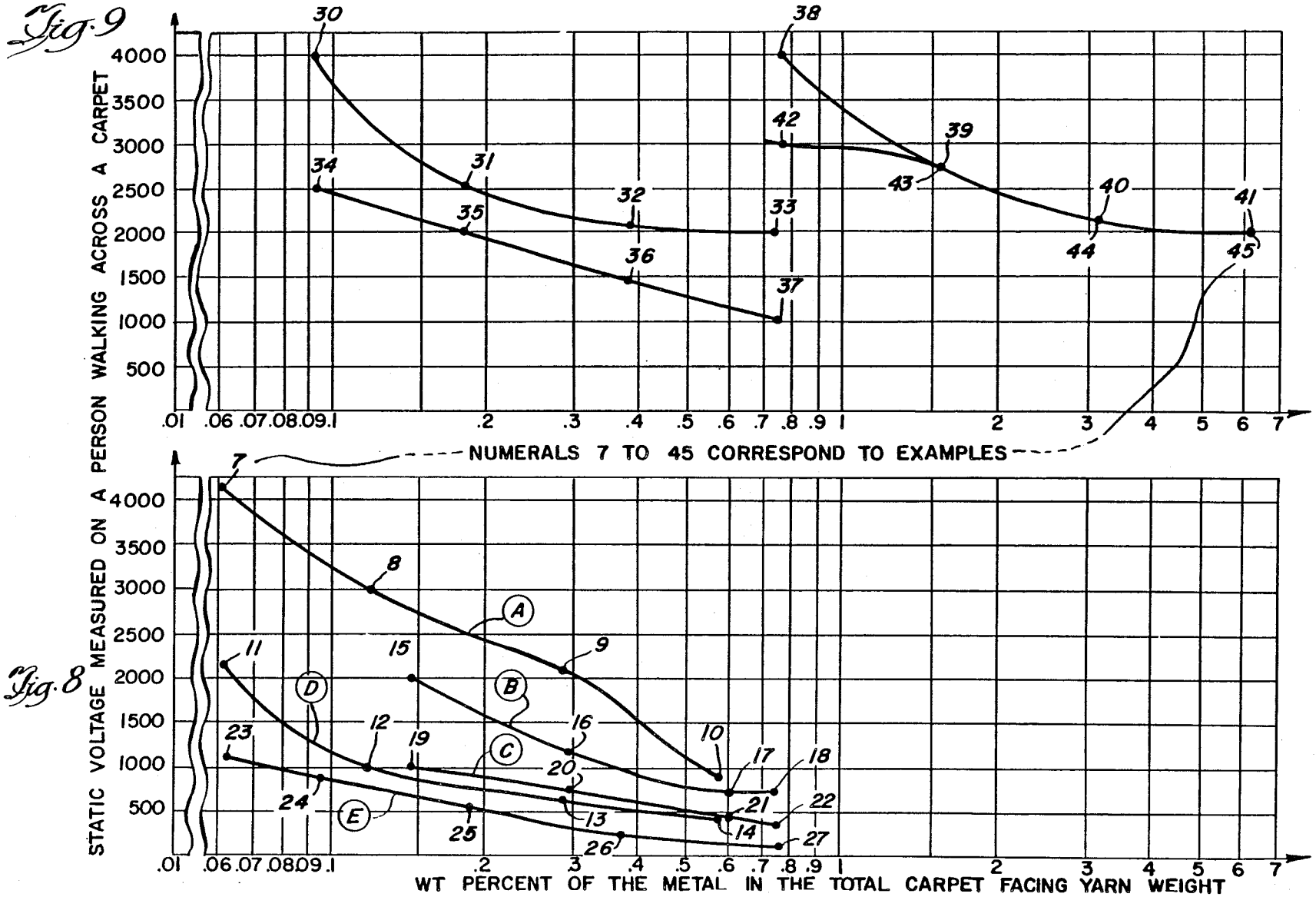
FIG. 8 is a graph with curves showing the relationships between different carpet constructions.
FIG. 9 is a graph with curves showing the relationship between embodiments of this inventio and wires in carpet constructions.

Each of these carpets was tested in an atmosphere control room having a temperature maintained at approximately 70° F. and a relative humidity of approximately 20%. The tests were conducted where a person walked and/or shuffled across the carpet and the electrostatic potential generated on the person was measured. As a reference point, the electrostatic charge developed when Example 1 was tested amounted to 12,000 volts. The graph on FIG. 8 shows the test results of each of the samples. The graph is arranged where the ordinate is the electrostatic voltage developed as a person walks and/or shuffles across the carpet and the abscissa is the total weight percent of the conductive fiber (metal fiber) present in the total facing yarn.

On the graph of FIG. 8, Curve A is for Examples 7 through 10; Curve B is for Examples 11 through 14; Curve C is for Examples 15 through 18; Curve D is for Examples 19 through 22, and Curve E is for Examples 23 through 27. It has been found that increasing the weight of the conductive fiber in the toral carpet yarn does not necessarily improve the antistatic control characteristics. It has been found desirable to create a concentration of conductive fibers in the final yarn as long as the concentration does not lead to conductive lengths beyond approximately 8 feet. Another series of curves on the graph shown in FIG. 9 indicate the test results made on another series of carpet samples which show the antistatic characteristics of another set of carpet examples. Four series of carpets made by tufting continuous filament nylon were prepared, each carpet containing the same amount and size of carpet facing yarn.

EXAMPLE 28

A 100% continuous filament nylon carpet having a facing yarn weight of 25 ounces per square yard was constructed by tufting the facing yarns to a 10 ounce per square yard primary jute backing.

EXAMPLE 29

Same as Example 28 but with the addition of a conductive latex coating to the jute backing.

EXAMPLE 30

Same as Example 28 but every 16th carpet facing yarn end had the fine yarn of Example 1 plied therewith.

EXAMPLE 31

Same as Example 28 but every 8th carpet facing yarn had the fine yarn of Example 1 plied therewith.

EXAMPLE 32

Same as Example 28 but every 4th carpet facing yarn end had the fine yarn of Example 1 plied therewith.

EXAMPLE 33

Same as Example 28 but every 2nd carpet facing yarn end had the fine yarn of Example 1 plied therewith.

EXAMPLE 34

Same as Example 30 except the carpet had a conductive latex applied to the backing thereof.

EXAMPLE 35

Same as Example 31 except the carpet had a conductive latex applied to the backing thereof.

EXAMPLE 36

Same as Example 32 except the carpet had a conductive latex applied to the backing thereof.

EXAMPLE 37

Same as Example 33 except the carpet had a conductive latex applied to the backing thereof.

EXAMPLE 38

Same as Example 28 but every 16th carpet facing yarn end had a fine continuous 3 mil stainless steel wire plied therewith.

EXAMPLE 39

Same as Example 28 but every 8th carpet facing yarn end had a fine continuous 3 mil stainless steel wire plied therewith.

EXAMPLE 40

Same as Example 28 but every 4th carpet facing yarn end had a fine continuous 3 mil stainless steel wire plied therewith.

EXAMPLE 41

Same as Example 28 but every 2nd carpet facing yarn end had a fine continuous 3 mil stainless steel wire plied therewith.

EXAMPLE 42

Same as Example 38 except the carpet had a conductive latex applied to the backing thereof.

EXAMPLE 43

Same as Example 39 except the carpet had a conductive latex applied to the backing thereof.

EXAMPLE 44

Same as Example 40 except the carpet had a conductive latex applied to the backing thereof.

EXAMPLE 45

Same as Example 41 except the carpet had a conductive latex applied to the backing thereof.

All of the examples were tested in a controlled atmosphere room where the temperature was approximately 72° F. and relative humidity was about 10%. The results of these tests were plotted on a graph where the ordinate is the voltage measured on a person walking and/or shuffling across a carpet and the abscissa is the percentage of total weight of conductive fiber (metal staple fiber or wire) to total weight of the carpet facing yarn. As reference points, the electrostatic potential developed when Example 28 was tested was 12,000 volts and when Example 29 was tested was 7,500 volts. The results obtained indicate that, by using a conductive wire in the carpet (Examples 37 through 40), there is no enhancement in control of static electricity when a conductive latex was added to the carpet backing (Examples 41 through 44). However, just the contrary was true when a conductive latex (Examples 33 through 36) was added to the carpet backing of Examples 30 through 33.

By combining the results obtained from the test shown on FIGS. 8 and 9, it has been found that the enhancement in static control on a carpet may be attributed to several factors, to wit:

1. The conductive staple fibers in the fine heterogeneous hybrid blended spun yarn function as small brushes to reduce the ability to accumulate static electricity.

2. The greater the number of conductive staple fibers in the fine heterogeneous hybrid blended spun yarn (due to the reduction in size of the conductive fibers), further reduces the ability to accumulate static electricity.

3. The blending technique used to make the fine heterogeneous hybrid blended spun yarn influences the static control ability of the carpet by providing a close cluster (in cross section) of the conductive fibers.

4. The conductive fiber cluster radially migrates along the length of the heterogeneous spun yarn.

Obviously, the exact mechanism by which static is controlled in carpets depend on a multitude of related factors and many others than those listed above may be equally or more important.

Tests conducted on the carpet examples containing the fine heterogeneous hybrid blended spun yarn have indicated that when such yarns are woven or tufted into the carpet facing structure, the linear continuous contact distance of conductive fibers is much shorter than the linear contact length of the conductive fibers for the yarn itself. It has been found that this is largely due to the fact that such a yarn in a carpet is in a serpentine configuration, as shown in FIG. 7, and is attributable to the looping effect of the carpet construction. Other factors influencing the conductive length of the fine heterogeneous yarn in the carpet facing yarn are the breakage of conductive fibers during plying, carpet manufacturing operations and the like. The pile height of the carpet facing yarns will affect this distance.

Thus, it has been described that by the proper construction of a fine heterogeneous hybrid blended spun yarn made from conductive and non-conductive fibers and combined with a carpet facing yarn, a significant effect in control of the generation of static electricity can be achieved. It is within the scope of this invention that shock-free carpeting can be provided wherein the weight percentage of the conductive fibers (that are in contact for only short preselected discrete lengths) can vary from 0.5% to 0.05% and less.

The fine heterogeneous yarn may be introduced in the carpet structure with every Nth carpet facing yarn or end in a regular preselected pattern or arrangement. The Nth carpet facing yarn may be every 50th facing yarn or end so that the forty-nine adjacent carpet facing yarns or ends inbetween the Nth, e.g., 50th, yarns or ends do not have the fine heterogeneous yarn. It is fully contemplated that the Nth end may be, for example, every 50th, 40th, 30th, 25th, 20th, 15th, 12th, 8th, 4th, 3rd, 2nd or every end, or other spacing, as desired. Alternatively, the carpet structure may be such that the Nth end (that contains the fine yarn) is introduced with the primary carpet facing yarn in any desired mathematical series (as long as the carpet is antistatic); for example, the fine yarn is introduced with carpet facing ends in a pattern such that the firstend containing the fine yarn is spaced 6 ends from the next end containing the fine yarn, which in turn is spaced 4 ends from the next end containing the fine yarn, which in turn is spaced 2 ends from the next end containing the fine yarn, which in turn is spaced 6 ends from the next end containing the fine yarn, etc.; and thus the pattern starts to repeat itself. Any such specific or random arrangement or spacing may be used as desired. The specific arrangement and spacing of the fine yarn may vary according to (1) the specific carpet construction; (2) the organic material used for the carpet facing yarn; (3) the method of making the carpet, e.g., weaving, tufting, knitting, and the like; and (4) the pattern of the carpet. Thus the exact spacing of such a fine discontinuously electrostatically conductive yarn may be preselected for each specific carpet. It has been found that for cut pile carpets, it is necessary to add a conductive latex to the backing of the carpet because of certain unique characteristics of cut pile carpets. It is fully contemplated to be within the scope of this invention that static electricity can be equally well controlled in other textile fabrics including pile fabrics, upholstery, blankets, drapes, industrial textiles (e.g., belting, wet and dry paper-machine felts, filter bags, filtration fabrics) and the like in addition to carpets. It has also been found that this type of fabric structure provides for easier cleaning because the dirt holding capacity of the fabric has been reduced. Although specific embodiments of the invention have been described, many modifications and changes may be made in the configurations of the fine heterogeneous hybrid blended spun yarn, the methods of blending such a heterogeneous or non-homogeneous fine yarn, the desired and preselected spacing of such a fine yarn in fabrics (i.e., carpets) and in the materials used to make the desired fabric and/or fine yarn, without departing from the spirit and the scope of the invention as defined in the appended claims.

I claim:

1. The method of drawing and blending textile fiber and metal filaments while maintaing contact with each other comprising, feeding or least one bundle of fibers of textile material through draw rolls, simultaneously feeding a multifilament metal bundle through said draw rolls, guiding said metal bundle relative to said textile bundle to cause the latter continuously to cushion said metal bundle with respect to said draw rolls when passing therethrough while controlling the tension force on said metal filaments, to break limited numbers of said filaments generally continuously during the period of drawing.

2. The method according to claim 1 wherein said bundle of textile material and bundle of multifilament metal are fed into a plurality of

3. The method according to claim 1 wherein said textile bundles and metal bundles have similar surface friction characteristics with respect to said draw rolls.

4. The method according to claim 3 wherein said textile bundle is cotton and said metal bundle is stainless steel.

5. The method according to claim 4 wherein said stainless steel is made of metal filaments in the 4 to 12 micron range.

6. The method according to claim 1 wherein the textile bundles after drawing are passed through a roving and spinning steps to create yarn.

7. The method of drawing and blending textile fibers and electrostatically conductive filaments while maintaining contact with each other comprising:

feeding at least one bundle of fibers of textile material through draw rolls;

simultaneously feeding a bundle of electro-statically conductive filaments through said draw rolls;

positioning said bundle of conductive filaments relative to said textile bundle to cause the latter continuously to cushion said bundle of conductive filaments when passing therethrough; and controlling the tension force on said conductive filaments as said bundle of filaments and said bundle of fibers pass through said draw rolls to break limited numbers of said filaments generally continuously during the period of drawing.

8. The method of drawing and blending as specified in claim 7, in which the filaments of the electrical conductive filament bundle are of metal.

9. The method of drawing and blending as specified in claim 8, in which the filaments are of stainless steel.

10. The method of drawing and blending as specified in claim 8, in which the filaments are of stainless steel, each filament having a size range from about 2 microns to 25 microns.

11. The method of drawing and blending as specified in claim 7, in which two bundles of textile material in superposed relation are passed through the draw rolls in the step of feeding; and in the positioning step, the bundle of conductive filaments is interposed between the two bundles of textile material to cushion the bundle of filaments when passing through the draw rolls.

12. The method of drawing and blending as specified in claim 7, in which each filament is continuous to provide a bundle of conductive material in the form of tow.

13. The method of drawing and blending as specified in claim 7, in which each filament comprises an organic substrate with an electrically conducting coating thereon.

14. The method of drawing and blending as specified in claim 7, in which the bundles after drawing are passed through a roving step and a spinning step to create yarn.

15. The method of drawing and blending textile fiber and metal filaments in a roller drafting machine having a first pair of rotatable draw rolls and a second pair of rotatable draw rolls spaced longitudinally of said first pair of draw rolls, comprising the steps of:

feeding at least one bundle of organic staple fibers through the first and second pairs of draw rolls;

simultaneously feeding a bundle of metal filaments through said first and second pairs of draw rolls, at least a portion of the metal filaments being of sufficient length to extend between said first and second pairs of draw rolls;

positioning said bundles of fibers and metal filaments so that the bundles are superposed to cushion the metal filaments against the fibers as the bundles pass through said first and second draw rolls; and rotating the second pair of draw rolls at a greater angular velocity than the first pair of draw rolls to exert tension upon the metal filaments extending between said pairs of draw rolls so as to break said tensioned metal filaments generally continuously during the period of drawing.

16. The method of drawing and blending as specified in claim 15, in which the filaments are of stainless steel.

17. The method of drawing and blending as specified in claim 15, in which the filaments are of stainless steel, each filament having a size range from about 2 microns to about 25 microns.

18. The method of drawing and blending as specified in claim 15, in which each filament is continuous to provide a metal filament bundle in the form of tow.

19. The method of drawing and blending as specified in claim 15, in which the bundles after drawing are passed thrugh a roving step and a spinning step to create yarn.

20. The method of drawing and blending as specified in claim 15, in which two bundles of organic staple fibers in superposed relation are passed through the draw rolls in the step of feeding, and in the positioning step, the bundle of metal filaments is interposed between the two bundles of fibers to cushion the bundle of metal filaments when passing through the draw rolls.

21. The method of drawing and blending electrostatically nonconductive textile fiber and electrostatically conductive filaments in a roller drafting machine having a first pair of rotatable draw rolls and a second pair of rotatable draw rolls spaced longitudinally of said first pair of draw rolls, said method comprising the steps of:

feeding at least one bundle of electrostatically nonconductive fibers through the first and second pairs of draw rolls;

simultaneously feeding a bundle of electrostatically conductive filaments through said first and second pairs of draw rolls, at least a portion of said filaments being of sufficient length to extend between said first and second pairs of draw rolls;

positioning said bundles of fibers and conductive filaments so that the bundles are superposed to cushion said filaments against the fibers as the bundles pass through said first and second draw rolls; and exerting lengthwise tension upon the conductive filaments extending between the pairs of draw rolls so as to break said tensioned filaments into staple filament lengths and simultaneously to blend the staple filament lengths with the nonconductive fibers.

22. In a method of forming a heterogeneous blended yarn including the steps of combining and blending first and second fibers of dissimilar materials in a roving and spinning the roving into a yarn, the improvement comprising during spinning; clustering the first staple fibers radially along the length of and near the exterior surface of the yarn being forms.

23. The method of claim 22 wherein the first staple fibers are electrostatically conductive fibers.

24. The method of claim 22 wherein the first staple fibers are metal textile fibers, each fiber having an effective diameter ranging from about 25 microns to 2 microns or less.

25. The method of claim 22 wherein the first staple fibers comprise fibers with an organic substrate and a conductive coating thereon.

* * * * *

UNITED STATES PATENT AND TRADEMARK OFFICE

CERTIFICATE OF CORRECTION

PATENT NO. : 4,771,596

DATED : September 20, 1988

INVENTOR(S) : William G. Klein

It is certified that error appears in the above-identified patent and that said Letters Patent is hereby corrected as shown below:

Column 2, line 15, "baking" should be --backing--;

" line 59, after "non-conductive" insert -- " --;

Column 4, line 10, "inventio" should be "invention";

Column 8, line 25, "asize" should be "a size";

Column 10, line 11, "toral" should be -- total --;

Column 13, line 37, Claim 2, after "of" insert -- successive sets of draw rolls and said metal bundle is guided into the first set of rolls. --

Signed and Sealed this

Twenty-eighth Day of March, 1989

*Attest:*

DONALD J. QUIGG

*Attesting Officer*

*Commissioner of Patents and Trademarks*